United States Patent [19]

Rogers

[11] Patent Number: 4,844,454

[45] Date of Patent: Jul. 4, 1989

[54] PORTABLE, MANUALLY OPERABLE KNEE EXERCISER

[76] Inventor: Stephen A. Rogers, 360 West 400 N., Springville, Utah 84663

[21] Appl. No.: 219,237

[22] Filed: Jul. 15, 1988

[51] Int. Cl.[4] ..... A63B 21/00; A61H 1/02

[52] U.S. Cl. ..... 272/126; 272/93; 272/139; 128/25 R

[58] Field of Search ..... 272/139, 126, 93, 96, 272/130, 144, 142, 116, 117, 120, 121, 137; 128/25 R, 24, 25 B

[56] References Cited

U.S. PATENT DOCUMENTS

| | | | |
|---|---|---|---|
| 3,000,632 | 9/1961 | Fuchs | 272/126 |
| 4,546,968 | 10/1985 | Silberman | 272/117 |
| 4,784,121 | 11/1988 | Brooks | 272/93 |

FOREIGN PATENT DOCUMENTS

| | | | |
|---|---|---|---|
| 2111416 | 10/1972 | Fed. Rep. of Germany | 272/144 |

*Primary Examiner*—Richard J. Apley
*Assistant Examiner*—S. R. Crow
*Attorney, Agent, or Firm*—Thorpe, North & Western

[57] ABSTRACT

A self-operable knee therapy device includes a first elongate platform on which the lower leg of a person may be secured so that the back of the leg is in contact with the platform, a second elongate platform pivotally joined at one end to an end of the first platform and on which the upper leg of the person may be secured with the back of the upper leg being in contact with the second platform, and an elongate central support member pivotally joined at its upper end to the joined ends of the first and second platforms for supporting the joined ends in an elevated position. A handle is coupled to the first platform to enable grasping by a user so that when the handle is moved away from the person, the free end of the first platform is caused to pivot downwardly, and when the handle is moved toward the person, the free end is caused to pivot upwardly. By manual movement of the handle, the lower leg can be pivoted relative to the upper leg of a person in a selective manner to exercise and rehabilitate the knee and/or leg muscles.

16 Claims, 1 Drawing Sheet

PORTABLE, MANUALLY OPERABLE KNEE EXERCISER

BACKGROUND OF THE INVENTION

This invention relates to a portable, compact, manually operable device for exercising a person's knees and leg muscles.

It is common practice today to prescribe and schedule a therapy regimen for patients following knee and leg surgery. The reason for this, of course, is that following such surgery, the knee joint typically will have lost a significant amount of flexibility and range of motion. Additionally, the patient's leg muscles oftentimes need strengthening since, immediately after the surgery, generally little or no motion or use of the leg is allowed.

Therapists employ a variety of techniques for enabling a patient to regain a full range of motion and extension of the knee joint and regain strength in the leg muscles including massaging and manipulation applied by the therapist to the patient, and exercising and stretching to be carried out by the patient alone. A number of devices, mechanisms and apparatus have been proposed for use in facilitating knee and leg rehabilitation, some of such devices being disclosed in U.S. Pat. Nos. 4,114,610, 3,000,632, 4,463,947, 4,637,379, 4,509,509, and 4,599,996. Although some of the apparatus disclosed in these patents and elsewhere would apparently accomplish the desired knee and leg therapy and rehabilitation, such apparatus typically is also complicated in structure, cumbersome and costly.

SUMMARY OF THE INVENTION

It is an object of the invention to provide a simple and easy to use device for exercising the knees and leg muscles of a person.

It is also an object of the invention to provide such a device which will effectively provide for restoring a full range of motion and extension of a knee joint through a regimen of self-controlled exercise.

It is a further object of the invention to provide such a device which may be readily folded or adjusted into a compact volume for storage.

The above and other objects of the invention are realized in a specific illustrative embodiment which includes a first elongate member having a linking end and a rear end for supporting a person's lower leg, straps or other securing devices for securing the lower leg on the first member, a second elongate member having a linking end and a front end and being hingedly attached at its linking end to the linking end of the first member, for supporting a person's upper leg, and straps or other devices for securing the upper leg on the second member. A central support member is attached to the second member for supporting it in an elevated position to thus elevate the knee joint. A handle is attached to the linking end of the first member to project rearwardly therefrom for grasping by a person whose lower leg is secured on the first member and whose upper leg is secured on the second member, with the knee being positioned generally over the linking ends of the first and second members.

After a person's leg is secured on the apparatus as indicated above, the handle may be grasped and pulled toward the person to cause the first member to pivot upwardly about its linking end to thereby tend to straighten the person's leg. Moving the handle away from the person causes the first member to pivot downwardly and, of course, move the lower leg downwardly causing the knee to bend. The person may employ a variety of different exercises to strengthen the leg muscles and to exercise the knee including providing a hand restraining force on the handle to counter the pivoting of the first member through use of the leg muscles, simply relaxing the leg muscles and causing the first member to pivot upwardly and downwardly strictly by hand movement of the handle, etc.

In accordance with one aspect of the invention, the handle is constructed of a U-shaped element having two legs, each joined to a respective side of the first member, and a cross piece curved to extend up and over the upper leg of the person when the first member is pivoted to a position where it is generally colinear with the second member. That is, when the leg is substantially straight so that the first and second members lie generally in a plane, the handle will loop from the sides of the first member up and over the leg so as not to contact the upper leg and be a hinderance when attempting to straighten the leg. Also, in accordance with another aspect of the invention, the handle is formed to be readily attachable to or detachable from the first member to facilitate storage, portability, and general manipulation and use of the apparatus.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
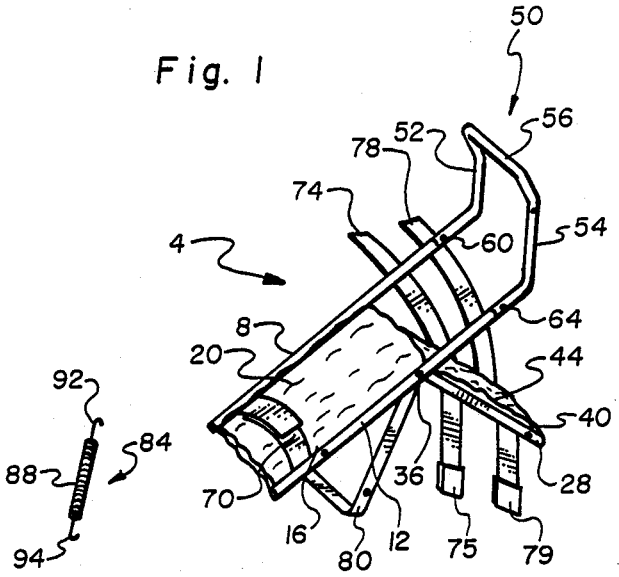
FIG. 1 shows a perspective view of knee exerciser apparatus made in accordance with the principles of the present invention.

Referring to the drawings, there is shown one specific illustrative embodiment of knee exerciser and rehabilitation apparatus 4 constructed in accordance with the present invention. The apparatus includes a first pair of generally parallel, spaced-apart tubular side rails 8 and 12 on which is mounted toward the forward ends thereof a platform 16. The tubular side rails 8 and 12 might illustratively be made of metal or hard plastic, and the platform 16 might illustratively be made of wood, aluminum or other metal plate, etc. The plate 16 is secured on the tubular side rails 8 and 12 by screws, adhesive, or other fastening devices.

Disposed on top of the platform 16 is a pad 20 which essentially covers the platform its full length and width. The pad 20 advantageously could be made of foam rubber, cloth covered batting material, or similar soft and resilient material. The pad 20 could be adhesively attached to the platform 16, held in place by hook and loop fastener mechanisms to allow for detaching the pad, or other well known attachment elements.

Figure 4:
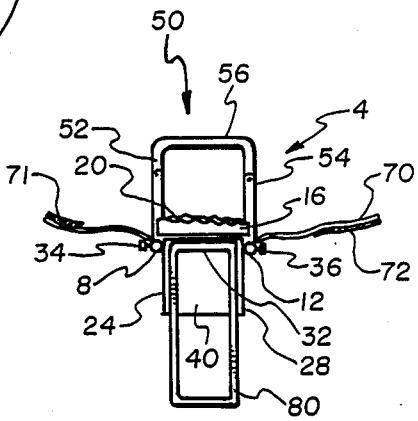
FIG. 4 shows a front, elevational view of the apparatus of FIG. 1.

The apparatus 4 also includes a second pair of generally parallel, spaced-apart side rails 24 and 28 hingedly or pivotally joined at one end thereof to the side rails 8 and 12. The ends of the side rails 24 and 28 are fitted inside the side rails 8 and 12, as best seen in FIG. 4, and an axle or rod 32 is inserted through aligned openings in the side rails to pivotally join the rails together. The rod 32 could be provided with a variety of end caps 34 and 36 to prevent the rod from sliding sideways from the openings in the side rails.

Mounted on top of the side rails 24 and 28 is a platform 40, similar to platform 16, and on the platform 40 is disposed a pad 44, similar to the pad 20 already described. The side rails 24 and 28 might advantageously be solid metal or hard plastic rods, or could be similar to side rails 8 and 12 and be formed of tubular elements. The platform 40 and pad 44 could be secured to the side rails 24 and 28 in the manner similar to that described for platform 16 and pad 20.

Figure 2A:
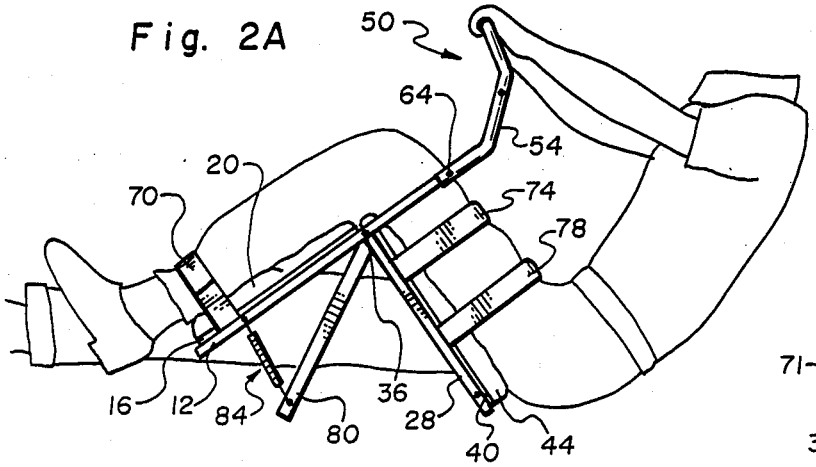
FIGS. 2A and 2B show side, elevational views of the apparatus of FIG. 1, with a person's leg strapped thereon, with FIG. 2A showing the apparatus in a position where the person's leg is bent and FIG. 2B showing the apparatus in a position where the person's leg is substantially straight.
Figure 2B:
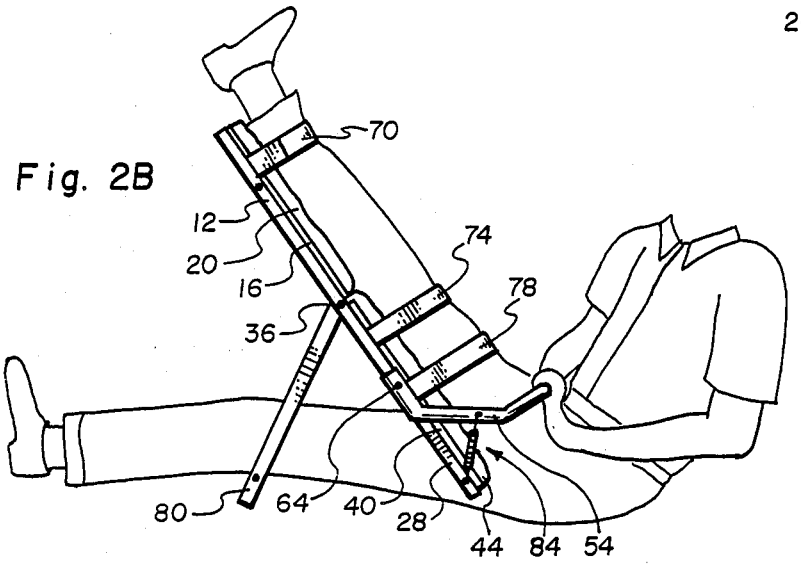

Side rails 8 and 12 extend rearwardly from the pivot axis, represented by the rod 32, a short distance as best seen in FIGS. 1, 2A and 2B. A handle 50 is detachably mountable on the ends of the side rails 8 and 12 as shown in the drawings. The handle 50 comprises a generally U-shaped element having a pair of substantially parallel, although curved, legs 52 and 54 joined at one end by a cross piece 56. The legs 52 and 54 extend rearwardly and colinearly from the side rails 8 and 12 and then bend upwardly at about a 45 degree angle (see FIGS. 2A and 2B) a short distance and then further upwardly at about a 90 degree angle for a short distance. The handle 50 would advantageously be made of a single piece of tubing, such as metal or hard plastic, formed into the desired shape. The tubing for the handle 50 is dimensioned to slideably receive therein the side rails 8 and 12. That is, the side rails 8 and 12 are dimensioned to slide into the free ends of arms 52 and 54 respectively of the handle 50 as shown in the drawings. Detent elements 60 and 64 maintain the handle 50 in the "installed" or attached position but also allow for releasing the handle so that it may be removed from the ends of the side rails. A coating could be applied to the handle 50 to make the handle less slippery and more comfortable for grasping by a user. Such a coating might illustratively be tubular foam rubber.

Figure 3:
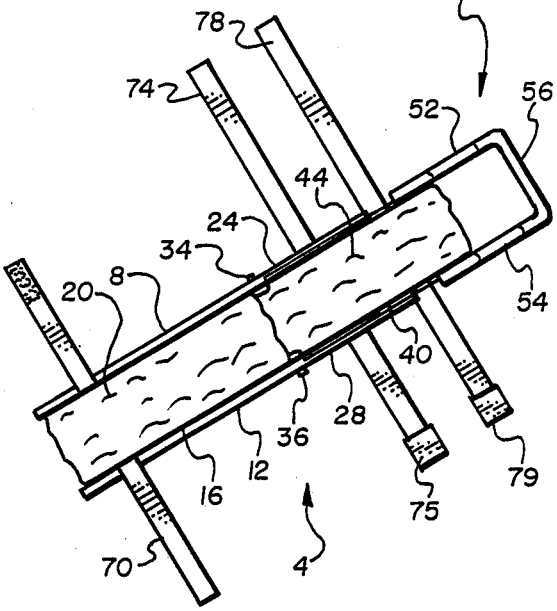
FIG. 3 shows a top, plan view of the apparatus of FIG. 1, with the handle shown detached.

Mounted on the apparatus 4 are three straps, strap 70 which extends underneath the platform 16 and over the side rails 8 and 12 for wrapping about the lower leg of a person using the apparatus (see FIGS. 4, 2A and 2B), and straps 74 and 78 which are fitted under platform 40 and above side rails 24 and 28 to wrap about and secure the upper leg of a person using the apparatus. Strap 70 is secured over a person's lower leg by hook and loop fastening sections 71 and 72 (FIG. 4) mounted on the strap, and strap 74 and 78 are secured over a person's upper leg by conventional seat-belt buckles 75 and 79 (FIGS. 1 and 3). The ends of strap 70 are secured together by simply mating the two hook and loop fastener sections 71 and 72 and pressing them together, while the straps 74 and 78 are secured together by feeding the free ends of the straps into and through the corresponding buckles and then cinching the straps tightly about the leg. Of course, a variety of fastening arrangements could be used on the straps.

A central support leg 80 is pivotally mounted at one end to the rod 32 to pivot relative to both the side rails 8 and 12 and the side rails 24 and 28. Of course, all the side rails and the support leg 80 pivot about the rod 32 relative to one another. The support leg 80 is formed to have a generally U-shape, with the free ends of the support leg pivotally mounted on the rod 32 between side rails 24 and 28. The function of the support leg 80 is to maintain the pivot axis of the apparatus in an elevated position as best seen in FIGS. 2A and 2B. Various elevations may be achieved by simply changing the angle between the support leg 80 and the side rails 24 and 28. That is, the greater the angle, the lower is the elevation of the pivoting axis and vice versa. The support leg 80 might illustratively be made of aluminum or other metal.

An element of the apparatus which may optionally be used or not used is an elastic coupling 84 (FIG. 1). The coupling 84 includes a piece of surgical tubing 88 on the ends of which are hooks 92 and 94. The hooks 92 and 94 may be fixed on the ends of the tubing 88 by tying knots in the tubing and looping the hooks through the knots, by inserting the hooks in the plugs and then inserting and fixing glueing, clamping, etc. the plugs in the tube opening at the ends, by wrapping the hooks about respective ends of the tubing, etc. Use of the coupling 84 will be discussed momentarily.

The apparatus may be used by placing the lower leg on the pad 20 and using strap 70 to secure the leg on the pad and by placing the upper leg on pad 44 and using strap 74 and 78 to secure the leg on that pad, as seen in FIGS. 2A and 2B. The angle between the side rails 24 and 28 and the support leg 80 may then be adjusted to the position desired by the user to elevate the pivot axis and thus the knee to the desired elevation. In this position, the knee and leg of a person may be exercised in a variety of ways. For example, the person may simply grasp the handle 50, as shown in FIG. 2A, and pull the handle toward himself causing the platform 16 to pivot upwardly and therefore straighten out the leg as shown in FIG. 2B (assuming coupling 84 is not installed on the apparatus). Because the handle 50 is curved rearwardly and then upwardly in a loop over the upper leg, the platforms 16 and 40 may be positioned substantially coplanar to allow for straightening the leg. Of course, if the handle 50 were not so looped, it would contact the upper leg and prevent further pivoting of the platform 16 so that the coplanar relationship between the platform 16 and 40 could never be reached. Following straightening of the leg, the handle 50 could be pushed away from the person to cause the lower leg to be moved downwardly, bending and hopefully rehabilitating the knee.

To strengthen the leg muscles, the muscles could be flexed to resist both the straightening and bending of the leg by movement of the handle.

If it is desired to flex the knee by bending it as much as possible and more leverage is desired in pushing the handle 50 away from the person's body, the handle can simply be removed from the ends of the side rails 8 and 12, reversed, and then put back in position on the side rails, with the handle then projecting rearwardly and toward the person rather than away from the person. With the cross piece 56 closer to the person in this position, greater leverage can be exerted to push the handle away and therefore cause a greater bending of the knee.

As is clear from the above description, the apparatus 4 can be used for either passive motion (leg muscles relaxed) while bending and straightening the knee joint, or active motion (leg muscles flexed) to resist movement created by pushing the handle 50 away o pulling the handle toward the person.

Resistance to straightening the leg from the position of FIG. 2A, and thus exercise of certain leg muscles, can be provided by installing the coupling 84 between holes drilled in side rail 12 and support leg 80 as shown in FIG. 2A. The leg would be flexed to attempt to straighten it, in which case the coupling 84 would yield to a certain extent (depending on the elasticity of the coupling) and then draw the leg back upon relaxation of the leg. The coupling 84 could also be installed between holes drilled in the handle 50 and the side rail 28 as shown in FIG. 2B. In this position, the coupling 84 would tend to prevent bending of the leg to thus exercise certain other leg muscles.

The structure of the apparatus 4 allows for compact storage and portability since the handle 50 may simply be removed, and the side rails 8 and 12, support leg 80, and side rails 24 and 28 all pivoted towards one another s that the support leg 80 nests within side rails 24 and 28, and side rails 24 and 28 nest within side rails 8 and 12. Also, the structure is simple to manufacture and can be made of lightweight materials to further facilitate portability.

It is to be understood that the above-described arrangements are only illustrative of the principles of the present invention. Numerous modifications and alternative arrangements may be devised by those skilled in the art without departing from the spirit and scope of the present invention and the appended claims are intended to cover such modifications and arrangements.

What is claimed is:

1. Portable, manually operable knee exerciser apparatus comprising a first elongate member having a linking end and a rear end for supporting a person's lower leg, first means for securing the lower leg on the first member, a second elongated member having a linking end and a front end and hingedly attached at its linking end to the linking end of the first member, for supporting a person's upper leg, second means for securing the upper leg on the second member, a central support member attached to the second member for supporting the second member in an elevated position, said central support member comprising an elongated prop pivotally joined at an upper end to the linking ends of the first and second members, and handle means attached to the linking end of said first member and projecting rearwardly therefrom for grasping by a person whose lower leg is secured on the first member and whose upper leg is secured on the second member, with the knee positioned over the linking ends of the first and second ends, to enable movement of the handle means and thereby cause pivoting of the first member with respect to the second member.

2. Knee exerciser apparatus as in claim 1 wherein said handle means comprises a generally U-shaped element having two legs, each joined to a respective side of the first member, and a cross piece curved to extend up and over the upper leg of the person when the first member is pivoted to a position where it is generally colinear with the second member.

3. Knee exerciser apparatus as in claim 2 wherein said handle means is decouplably attached to said first member.

4. Knee exerciser apparatus as in claim 3 wherein the handle means is attachable to the first member so that the cross piece curves away from the person when the first member is pivoted downwardly from the linking end of the second member, and is also attachable to the first member so that the cross piece curves toward the person.

5. Knee exerciser apparatus as in claim 2 wherein said first member comprises a pair of spaced-apart tubular elements, and a support section which extends between the two tubular elements to support the person's lower leg, and wherein the two legs of the handle means are formed for telescoping engagement with the tubular elements of the first member.

6. Knee exerciser apparatus as in claim 5 wherein the tubular elements of the first member and the legs of the handle means include detent means for releaseably securing the handle means to the first member.

7. Knee exerciser apparatus as in claim 1 wherein said first and second means comprise straps extending from opposite sides of the first and second members respectively to loop up and join over the lower leg and upper leg respectively.

8. Knee exerciser apparatus as in claim 1 wherein said central support member comprises a generally U-shaped bracket whose free ends are pivotally joined to the linking ends of the first and second members.

9. Knee exerciser apparatus as in claim 1 further comprising an elastic coupling element for detachably coupling between the first elongate member and the central support member to provide resistance to pivoting the first elongate member away from the central support member, and for detachably coupling between the second elongate member and the handle means to provide resistance to pivoting the handle means away from the elongate member.

10. A self-operable knee therapy device comprising a first elongate platform on which the lower leg of a person may be secured, with the back of the leg being in contact with the platform, a second elongate platform pivotally joined at one end to an end of the first platform, and on which the upper leg of the person may be secured, with the back of the upper leg being in contact with the second platform, an elongate support leg pivotally joined at its upper end to the joined ends of the first and second platforms for supporting the joined ends in an elevated position to enable the free end of the first platform to be pivoted above and below the elevated position, and handle means joined to the first platform for grasping by the person so that when the handle means is moved away from the person, the free end of the first platform is caused to pivot downwardly, and when the handle means is moved toward the person, the free end of the first platform is caused to pivot upwardly.

11. A device as in claim 10 wherein said handle means is detachably joinable to the first platform to project toward the person when he person's leg is secured to the first and second platforms.

12. A device as in claim 11 wherein the handle means comprises a generally U-shaped element having a pair of generally parallel legs joined to respective sides of the first platform, said legs extending rearwardly of the first platform and then upwardly, said handle means further comprising a cross piece joining the ends of the upward extensions of the pair of parallel legs.

13. A device as in claim 12 wherein said first and second platforms include padded surfaces against which the leg of the person may be placed.

14. A device as in claim 10 wherein the first platform comprises a first pair of generally parallel side rails and a plate disposed on the side rails, wherein the second platform comprises a second pair of generally parallel side rails and a plate disposed on the second pair of side rails, said second pair of side rails being pivotally joined at one end to the inside near one end of the first pair of side rails so that the second pair of side rails may nest within the first pair.

15. A device as in claim 15 wherein the first pair of side rails comprises a first pair of tubular elements, and wherein the handle means includes a pair of generally parallel tubular elements which may be telescopically joined at one end to said one end of respective ones of the first pair of tubular elements, and a tubular cross piece joining the other ends of the pair of tubular elements of the handle means

16. A device as in claim 10 further comprising an elastic coupler for attachment between the first platform and the support leg to provide resistance to pivoting the first platform away from the support leg, or between the handle means the second platform to provide resistance to pivoting the handle means away from the second platform.

* * * * *